United States Patent [19]

Wooding

[11] 4,213,291

[45] Jul. 22, 1980

[54] ALARM CLOCK CONSTRUCTION

[75] Inventor: Robert L. Wooding, Wolcott, Conn.

[73] Assignee: Robertshaw Controls Company, Richmond, Va.

[21] Appl. No.: 828,611

[22] Filed: Aug. 29, 1977

[51] Int. Cl.[2] ..... G04C 71/16

[52] U.S. Cl. ..... 368/263; 368/258; 368/262

[58] Field of Search ..... 58/16 R, 16 D, 19 R, 58/20, 21, 21.1, 21.15, 21.55, 22, 38 R, 38 A, 39, 152 B; 340/402, 403; 325/396

[56] References Cited

U.S. PATENT DOCUMENTS

| | | | |
|---|---|---|---|
| 1,887,303 | 11/1932 | Grossman | 58/16.5 |
| 3,440,814 | 4/1969 | Reimann | 58/19 R |

*Primary Examiner*—Edith S. Jackmon

*Attorney, Agent, or Firm*—Candor, Candor & Tassone

[57] ABSTRACT

An alarm clock construction having a frame carrying time mechanism and a timer motor for driving the time mechanism, the time mechanism including an alarm setting member for selecting a predetermined time the clock construction is to sound an alarm. A reed member is pivotally carried by the frame to pivot on an intermediate pivot point thereon and is adapted to pivot to an alarm producing position when the time mechanism reaches the predetermined time. An on-off alarm member has a biasing part for acting on the reed member on one side of the pivot point to tend to bias the reed member to the alarm producing position when the on-off alarm member is in the "on" position thereof and for acting on the reed member on the other side of the pivot point to tend to bias the reed member out of the alarm producing position when the on-off alarm member is in the "off" position thereof. An actuator member is movably carried by the frame and is movable to a position to temporarily hold the reed member out of the alarm producing position thereof even though the on-off alarm member is in the "on" position thereof, the actuator member movably carrying a pinion-like member that moves relative to the actuator member and cause the actuator member to move out of its alarm stopping position to again sound the alarm after the lapse of a certain time period.

11 Claims, 18 Drawing Figures

ALARM CLOCK CONSTRUCTION

BACKGROUND OF THE INVENTION

1. Field of the Invention

This invention relates to an improved alarm clock construction.

2. Prior Art Statement

It is well known that alarm clock constructions have been provided wherein each has a reed member that is moved to an alarm producing position when a preselected time is reached by the time mechanism thereof whereby the reed member is vibrated in such position to create an alarm sound, the predetermined time having been selected by an alarm setting member of the clock construction. Such reed member is normally biased toward the alarm producing position thereof and is held out of such position until the time mechanism permits the reed member to move into the alarm producing position thereof when the preselected time is reached by the clock mechanism.

Certain of such prior known alarm clock constructions each have means for temporarily turning off the alarm producing means of the alarm clock construction for a certain short time period after the lapse of which the alarm producing means again produces its alarm sound.

For example, see the following seven U.S. patents:

U.S. Pat. No. 3,109,200—Ring et al
U.S. Pat. No. 3,127,733—Robinson
U.S. Pat. No. 3,200,577—Ring et al
U.S. Pat. No. 3,475,899—Boyles
U.S. Pat. No. 3,524,314—Morton et al
U.S. Pat. No. 3,882,668—Boyles
U.S. Pat. No. 3,930,358—Boyles In each of the alarm clock constructions of the above seven patents, the alarm sounding reed member thereof appears to have one end fixed to the frame to provide for the pivot point thereof whereby the actuator member that controls the position of the reed member is believed to act on only one side of the pivot point of the reed member.

In regards to the means for intermittently turning off the reed member during the alarm sounding operation of the respective alarm clock construction, each of the above seven patents appears to have a timer operated member movably carried by a part of the alarm clock construction thereof other than the reed actuator member to cause the reed actuator member to stop holding the reed member in its non-alarm producing position after the lapse of a certain time period.

SUMMARY OF THE INVENTION

It is a feature of this invention to provide an improved reed member arrangement for an alarm clock construction or the like.

In particular, one embodiment of this invention provides an alarm clock construction having frame means carrying time means and a timer motor for driving the time means, the time means including an alarm setting means for selecting a predetermined time that the clock construction is to begin to sound an alarm. A reed member is pivotally carried by the frame means to pivot on an intermediate pivot point thereof and is adapted to pivot to an alarm producing position when the time means reaches the predetermined time. An on-off alarm member has biasing means for acting on the reed member on one side of the pivot point to tend to bias the reed member to the alarm producing position when the on-off alarm member is in the "on" position thereof and for acting on the reed member on the other side of the pivot point to tend to bias the reed member out of the alarm producing position when the on-off alarm member is in the "off" position thereof.

It is another feature of this invention to provide an improved actuator means for temporarily turning off the alarm producing means of an alarm clock construction of the like.

In particular, one embodiment of this invention provides an alarm clock construction having an alarm producing reed member for sounding an alarm when a preselected time is reached and having a movably mounted actuator member for temporarily turning off the alarm producing reed member for a certain time period by being moved from an alarm "on" position thereof to an alarm "off" position thereof to engage and hold the reed member in a non-alarm producing position thereof. A pinion means is movably carried by the actuator member and adapted to move relative to the actuator member for the certain time period after the actuator member is moved to the "off" position thereof to temporarily turn off the alarm producing reed member, the pinion means being adapted to thereafter cause the actuator member to move from the "off" position thereof back to the "on" position thereof after the lapse of the certain time period.

Accordingly, it is an object of this invention to provide an improved alarm clock construction having one or more of the novel features of this invention as set forth above or hereinafter shown or described.

Other objects, uses, and advantages of this invention are apparent from a reading of this description which proceeds with reference to the accompanying drawings forming a part thereof and wherein:

DESCRIPTION OF THE PREFERRED EMBODIMENTS

Figure 1:
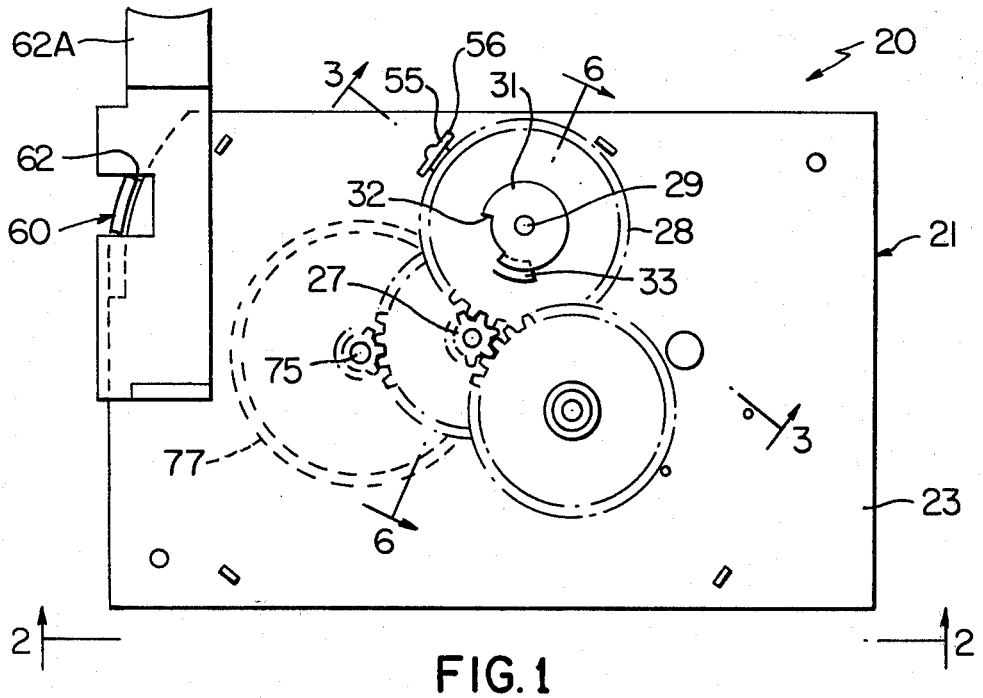
FIG. 1 is a fragmentary rear view of the alarm clock construction of this invention, the alarm clock construction being shown without a conventional covering case.

While the various features of this invention are hereinafter illustrated and described as being particularly adapted to provide an alarm clock construction for producing the normal waking alarm for domestic use and the like, it is to be understood that the various features of this invention can be utilized singly or in any combination thereof to provide an alarm producing means for other uses as desired.

Therefore, this invention is not to be limited to only the embodiments illustrated in the drawings, because the drawings are merely utilized to illustrate one of the wide variety of uses of this invention.

Figure 2:
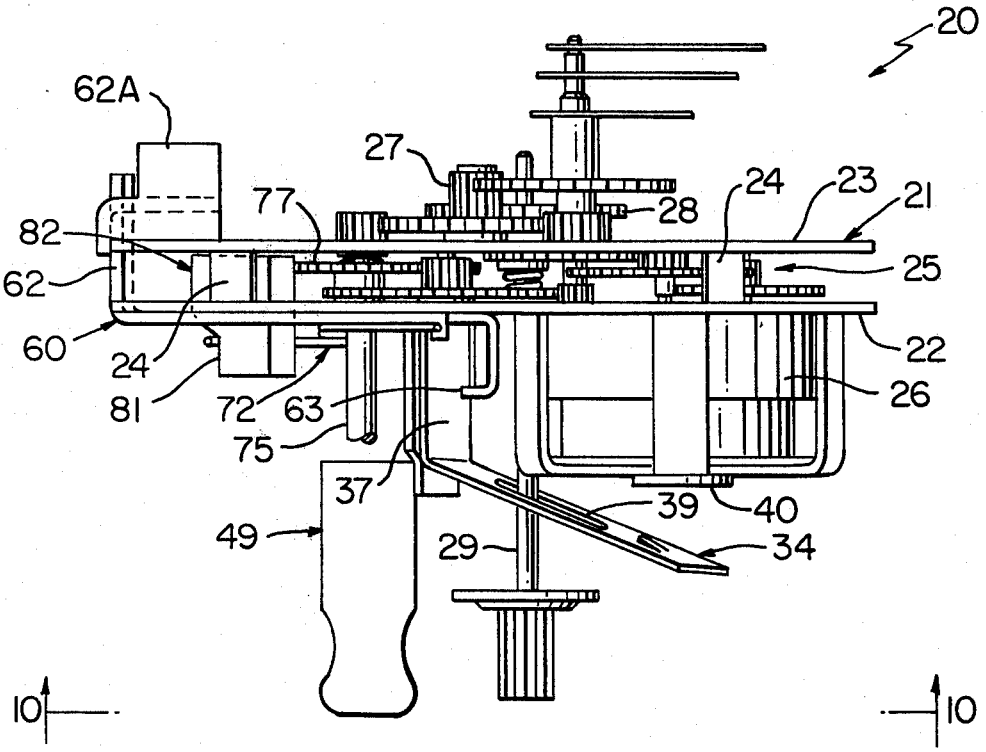
FIG. 2 is a cross-sectional view taken on line 2—2 of FIG. 1.
Figure 3:
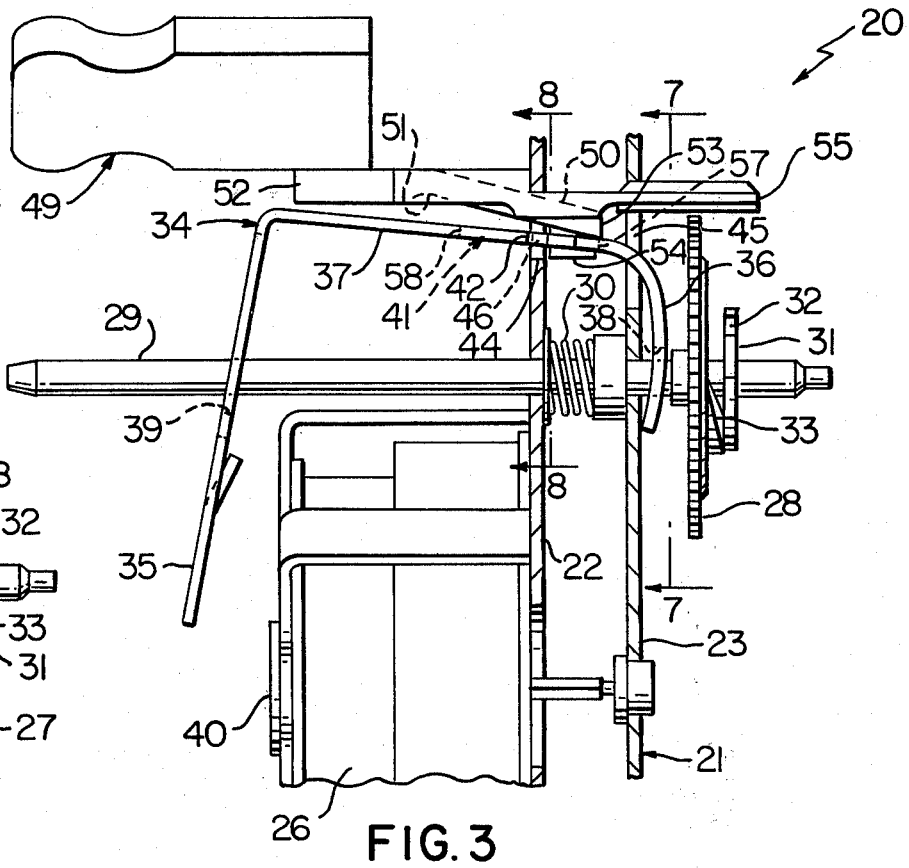
FIG. 3 is an enlarged fragmentary cross-sectional view taken on line 3—3 of FIG. 1 and illustrates the alarm setting member thereof disposed in the "off" position thereof.

Referring now to FIGS. 1, 2 and 3, the improved alarm clock construction of this invention is generally indicated by the reference numeral 20 and comprises a frame means that is generally indicated by the reference numeral 21 and comprises a pair of frame plates 22 and 23 secured together by suitable post means 24, FIG. 2, in spaced parallel relation to respectively carry conventional clock mechanism or time means that is generally indicated by the reference numeral 25 and an electric timer motor 26 for driving the time means 25 in an appropriate manner to indicate the time of day in the conventional manner through the cooperation of clock hands (not shown) and a dial face therefore (not shown).

Since the means for driving the time indicating hands of a clock construction is conventional in the art, no discussion of the structure and detail of operation of the timing means 25 of the clock construction 20 of this invention is necessary in order to understand the various features of this invention.

Figure 6:
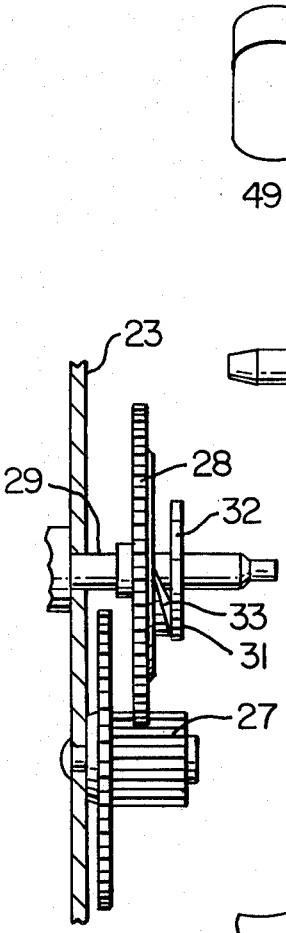
FIG. 6 is a fragmentary enlarged cross-sectional view taken on line 6—6 of FIG. 1.

In particular, it is only necessary to state that the pinion gear 27, FIG. 6, of the time means 25 rotates the gear 28 one revolution every 24 hours, the gear wheel 28 being rotatably mounted and axially movable on an alarm setting member or shaft 29 rotatably carried by the frame plates 22 and 23 and normally being held from rotation relative thereto by the friction caused by a compression spring 30 disposed between the frame plates 22 and 23 as illustrated in FIG. 3.

The alarm setting member 29 has a cam plate 31 fixed thereon with the cam plate 31 having a cam notch 32 formed therein as illustrated in FIG. 1 and being adapted to receive a cam projection 33 of the gear wheel 28 therein when the time means 25 reaches the time that is selected by the shaft 29.

For example, when the operator desires the alarm clock construction 20 to sound an alarm in a manner hereinafter described, the operator grasps the shaft 29 and rotates the same to the desired time in the future that the alarm clock 20 is to sound the alarm, the alarm setting member 29 controlling an indicator (not shown) in a manner well known in the art and once the same has been set for a predetermined time in the future, the cam notch 32 is rotatably disposed in advance of the cam portion 33 of the gear wheel 28 so that the gear wheel 28 must be rotated in the direction of the arrow of FIG. 1 until the cam portion 33 is fully disposed in alignment with the notch 32 of the cam plate 31 and such action only takes place when the time set by the alarm setting member 29 is reached by the timing means 25. At this time, the cam portion 33 of the gear wheel 28 is adapted to be axially received in the notch 32 by having the gear wheel 28 axially moved to th right on the shaft 29 in the manner illustrated in FIG. 5 to permit the alarm clock construction to sound an alarm in a manner hereinafter set forth.

Figure 9:
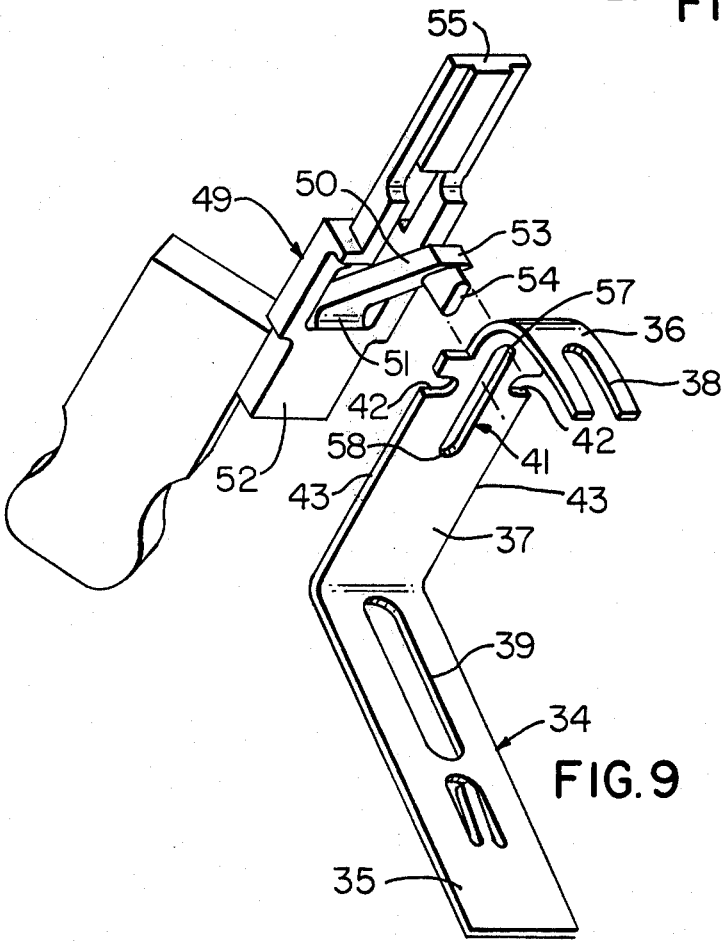
FIG. 9 is an exploded perspective view of the alarm setting member and reed member of the clock construction of this invention.

The improved reed or vibrator member of this invention is generally indicated by the reference numeral 34 and is best illustrated in FIG. 9, the reed member 34 being substantialy U-shaped to define a pair of opposed legs 35 and 36 disposed substantially parallel to each other and being integrally interconnected by a cross member 37 whereby the reed member 34 comprises a one-piece structure.

The vibrator member 34 is vibrated to create an alarm sound in a manner hereinafter described and since such vibrating action is similar to a sound producing vibrating "reed" member in a musical instrument, the vibratory member 34 will be referred to as a "reed member" throughout this application and its appended claims.

The end 36 of the reed member 34 has a slot 38 bifurcating or splitting the same so that the slot 38 is adapted to receive the alarm setting manner 29 therethrough in the manner illustrated in FIG. 3 when the reed member 34 has the end 36 thereof disposed intermediate the frame plate 23 and the gear wheel 28.

The other leg or end 35 of the reed member 34 has a slot 39 passing therethrough so that the alarm setting member 29 can pass through the slot to permit the end 35 of the reed member 34 to be disposed closely adjacent the core 40 of the timer motor 26 for a purpose hereinafter described.

The cross member 37 of the reed member 34 has a slot 41 provided therethrough with the slot 41 straddling a pair of opposed pivot notches 42 formed in the opposed side edges 43 of the cross member 37 and which define means for pivotally mounting the reed member 34 to the frame means 21.

Figure 8:
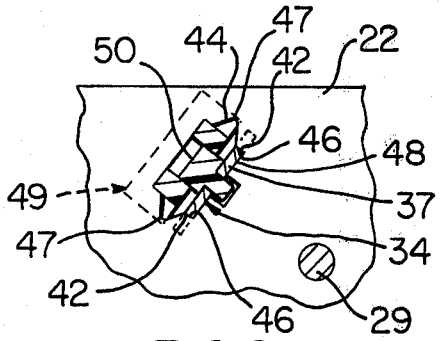
FIG. 8 is a fragmentary cross-sectional view taken one line 8—8 of FIG. 3.
Figure 7:
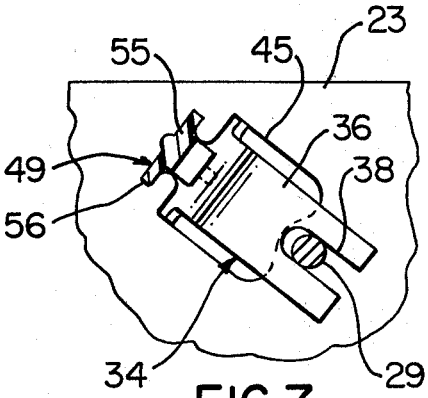
FIG. 7 is a fragmentary cross-sectional view taken on line 7—7 of FIG. 3.

In particular, the frame plate 22 is provided with an opening means 44 passing therethrough and of the configuration best illustrated in FIG. 8, the frame plate 23 also having an opening means 45 passing therethrough in aligned relation with the opening means 44 and having the configuration best illustrated in FIG. 7.

As illustrated in FIG. 8, the opening means 44 through the plate 22 defines a pair of pivot edges 46 which are adapted to be respectively received in the pivot notches 42 of the cross member 37 of the reed member 34 to pivotally mount the reed member 34 to the frame means 21, the end 36 of the reed member 34 readily passing through the opening means 45 of the plate 23 to have the slot 38 thereof receive the alarm setting member 29 therein as illustrated.

In this manner, the reed member 34 can be of the one-piece structure illustrated and can be readily assembled to the frame plates 22 and 23 in a simple assembly manner by having the leg 36 and cross member 37 readily slipped through the opening 44 at the larger portion 47 thereof until the notches 42 are aligned with the pivot parts 46 of the opening 44 to permit the notches 42 to receive the pivot sides 46 of the plate 22, the cross member 37 of the reed member 34 being biased against the end 48 of the opening 44 as illustrated in FIG. 8 so as to maintain the pivot edges 46 of the plate 22 in the notches 42 of the reed member 34 in a manner hereinafter described so that the reed member 34 is pivotally mounted to the frame means 21 at the pivot points 46 as will be apparent hereinafter.

The clock construction 20 is provided with an on-off alarm member that is generally indicated by the reference numberal 49 and is best illustrated in FIG. 9, the on-off alarm member 49 being formed of a suitable plastic material, such as Delrin, and is suitably formed to define an integral leaf like spring member 50 that has one end 51 integral with the body portion 52 of the on-off member 49 and the other end 53 thereof free from the body portion 52 while being provided with an outwardly directed tang 54 that is adapted to be received in the slot 41 of the cross member 37 of the reed member 34 when the on-off member 49 is assembled thereto in the manner illustrated in FIG. 3.

Figure 4:
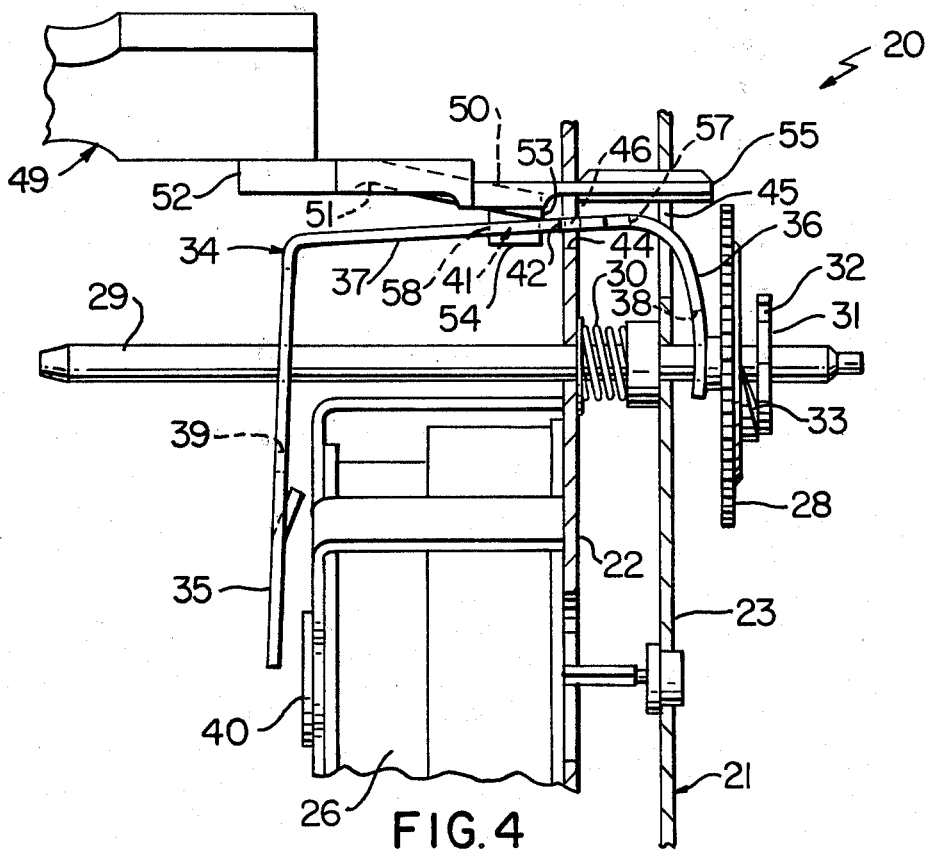
FIG. 4 is a view similar to FIG. 3 and illustrates the alarm setting member disposed in the "on" position thereof.

In particular, an end 55 of the on-off member 49 is adapted to be received through the opening 44 in the plate 22 as well as a portion 56 of the opening means 45 of the plate 23 as illustrated in FIG. 7 so as to be axially movable relative to the frame means 21 while the tang 54 is adapted to slide in the guide slot 41 of the cross member 37 between the opposed ends 57 and 58 thereof as illustrated respectively in FIGS. 3 and 4 whereby the outward movement of the on-off member 49 is limited by the tang 54 hitting the end 58 of the slot 41 of the reed member 34 as illustrated in FIG. 4 and the in position of the on-off position 49 is limited by the tang 54 hitting the end 57 of the slot 41 of the reed member 34 as illustrated in FIG. 3.

Figure 5:
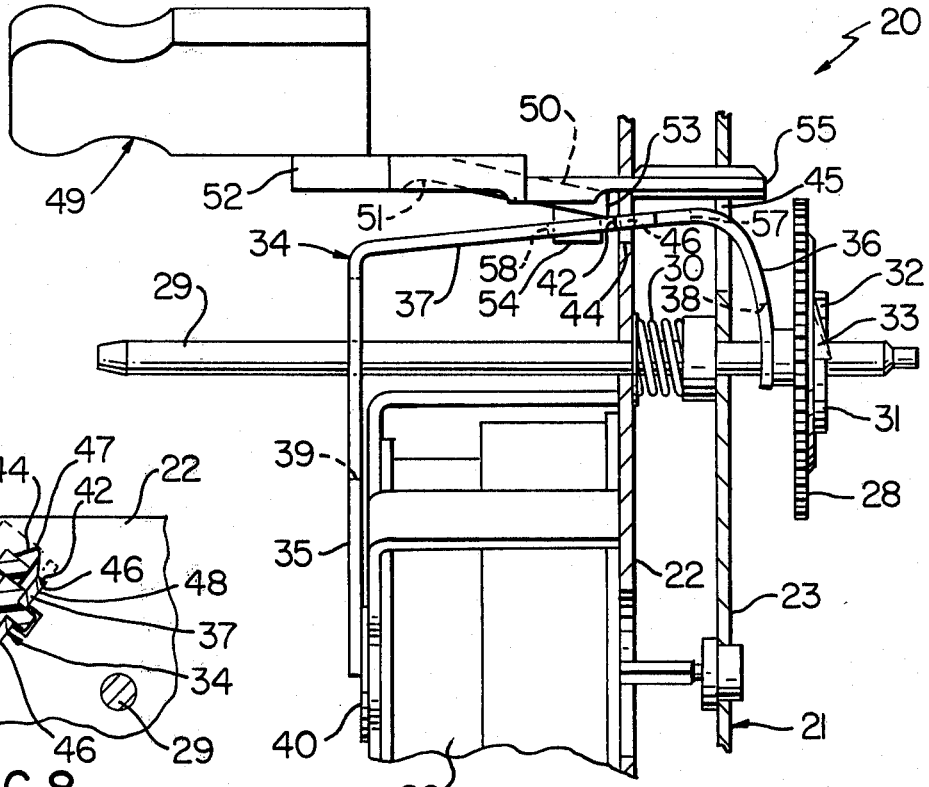
FIG. 5 is a view similar to FIG. 4 and illustrates the alarm clock construction during the alarm producing operation thereof.

When the on-off alarm member 49 is assembled with the reed member 34 in the frame means 21 in the clock construction 20, the spring leaf member 50 of the on-off alarm member 49 has the end 53 compressed toward the body portion 52 so that the force of the leaf member 50 continuously urges the end 53 of the leaf member 50 against the cross member 37 of the reed member 34 to not only hold the same against the end 48 of the opening 44 of the frame plate 22 as illustrated in FIG. 8, but also the force of the leaf member 50 tends to pivot the reed member 34 at the intermediate pivot point 46 thereof in the manner illustrated in FIGS. 3, 4 and 5.

In particular, when the on-off alarm member 49 is disposed in the in or "off" position of FIG. 3, it can be seen that the end 53 of the leaf member 50 of the on-off member 49 is acting to the right of the pivot point 46 of the reed member 34 so that the same tends to be pivoted in a clockwise direction about the frame plate 22 whereby the end or leg 36 of the reed member 34 is disposed against the frame plate 23 and is providing no force on the gear wheel 28 while the other leg or end 35 of the reed member 34 is disposed completely away from the core 40 of the motor 26 so that the same does not produce any alarm sound or noise. Thus, as long as the on-off alarm member 49 is in the in or "off" position of FIG. 3, the reed member 34 will not produce an alarm sound and whether or not the gear wheel 28 has the cam portion 33 thereof disposed within the notch 32 of the cam wheel 31 or not, the alarm clock construction 20 will not produce an alarm sound.

However, when the on-off alarm member 49 is pulled to the out or "on" position of FIG. 4, it can be seen that the end 53 of the leaf portion 50 of the on-off alarm member 49 is now disposed to the left of the pivot point 46 of the reed member 34 so that the end 53 of the leaf portion 50 of the on-off member 49 acts to pivot the reed member 37 in a counterclockwise direction in FIG. 4 whereby the end 36 of the reed member 34 is engaged against the gear wheel 28 in a manner tending to push the gear wheel 28 to the right on the alarm setting shaft 29 while the other end 35 of the reed member 34 is moved closely adjacent the core 40 of the motor 26.

However, as long as the cam portion 33 of the gear wheel 28 is not receivable in the notch 32 of the cam plate 31 as illustrated in FIG. 4, the end 35 of the reed member 34 is still held a sufficient distance from the core 40 of the motor 26 so that the reed member 34 will not make an alarm sound.

With the on-off alarm member 49 set in the "on" position of FIG. 4, and when the gear wheel 28 has the cam portion 33 thereof disposed in alignment with the notch 32 of the cam part 31 as illustrated in FIG. 5, the force being applied by the leaf portion 50 of the on-off alarm member 49 on the reed member 34 to further pivot the same in a counterclockwise direction now causes a further counterclockwise movement of the reed member 34 so that the end or leg 36 thereof shoves the gear wheel 28 to the right until the same is fully disposed against the cam plate 31 as illustrated in FIG. 5 and the end or leg 35 of the reed member 34 is disposed against the core 40 of the motor 26 to cooperate therewith to produce an alarm sound in a manner well known in the art. Thus, the alarm clock construction 20 will continuously produce the alarm sound as long as the on-off alarm member 49 is disposed in the "on" position of FIG. 5.

However, when the operator decides to turn off the alarm sound of the alarm clock construction 20, the operator merely pushes inwardly on the on-off alarm member 49 from the position illustrated in FIG. 5 back to the position illustrated in FIG. 3 whereby the end 53 of the leaf member 50 of the on-off alarm member 49 now passes to the right of the pivot point 46 of the reed member 34 to cause the reed member 34 to pivot in a clockwise direction and thereby move not only the leg 36 away from the gear wheel 28, but also move the leg 35 away from the core 40 of the motor 26 to thereby terminate the alarm sound of the alarm clock construction 20.

Thus, it can be seen that this invention provides an improved alarm clock construction 20 wherein the reed member 34 and the on-off alarm member 49 thereof cooperate in a unique manner to operate in a manner now to be described.

While the alarm clock construction 20 is running in a normal manner by the motor 26 being continuously energized in a conventional manner, should the operator desire to set the alarm clock construction 20 to produce its alarm sound at 6:00 A.M. and the time being indicated by the clock construction 20 is presently at 11:00 P.M., the operator grasps the alarm setting shaft 29 and rotates the same in a clockwise direction in FIG. 1 to a 6:00 A.M. setting thereof whereby if the cam portion 33 of the gear wheel 28 had been in the notch 32 of the cam part 31 thereof, such advancement of the cam plate 31 beyond the cam portion 33 of the gear wheel 28 causes the cam portion 33 of the gear wheel 28 to cam out of the notch 32 and thereby move the gear wheel 28 axially to the left on the alarm setting member 29 from the position illustrated in FIG. 5 to the position illustrated in FIG. 3. Thus, the cam portion 33 of the gear wheel 28 is held out of registry with the notch 32 in the cam plate 31 until the cam wheel 28 has been advanced in the clockwise direction of FIG. 1 by the timer motor 26 to align the cam portion 33 with the now set notch 32 of the cam plate 31 which occurs at 6:00 A.M.

Once the alarm setting member 28 has been set to the 6:00 A.M. position thereof, the operator pulls outwardly on the on-off alarm member 49 so that the same moves from the "off" position of FIG. 3 to the "on" position of FIG. 4 whereby the end 53 of the leaf portion 50 of the on-off alarm member 49 causes the reed member 34 to pivot about its pivot point 46 in a counterclockwise direction to the position of FIG. 4. Thus, the stored energy in the leaf member 50 continues to urge the gear wheel 28 to the right but is prevented from moving the gear wheel 28 further to the right as the cam portion 33 thereof is bearing against the cam plate 31 as illustrated in FIG. 4.

However, when 6:00 A.M. is reached, the gear wheel 28 has been rotated by the pinion gear 27 of FIG. 6 to position the cam portion 33 of the gear wheel 28 in registry with the notch 32 in the cam plate 31 so that the force of the leaf portion 50 of the on-off alarm member 49 further pivots the reed member 34 in a counterclockwise direction about its pivot point 46 from the position of FIG. 4 to the position of FIG. 5 so that the gear wheel 28 is now disposed further to the right on the alarm setting member 49 and the end 35 of the reed member 34 is now moved against the core 40 of the motor 26 to cause an alarm producing sound in a conventional manner which continues to be sounded until the operator pushes inwardly on the on-off alarm member 49.

In particular, movement of the on-off alarm member 49 from the "on" position of FIG. 5 back to the in or "off" position of FIG. 3 causes the leaf portion 50 to now have the end 53 thereof act on the reed member 34 to the right of the pivot point 46 thereof and thereby cause clockwise pivotting of the reed member 34 from the position illustrated in FIG. 3 whereby the end 35 of the reed member 34 is now held fully away from the core 40 of the motor 26 so that the alarm producing sound is terminated.

Therefore, it can be seen that it is a relatively simple operation to set the alarm clock construction 20 of this invention to sound an alarm sometime in the future and the alarm clock construction 20 will sound such alarm automatically when the predetermined time is reached, the alarm clock construction continuing to produce the sound until the on-off alarm member 49 is moved to the "off" position thereof.

However, the alarm clock construction 20 of this invention can be additionally provided with means for temporarily turning off the alarm producing sound thereof for a short interval of time, such as for five minutes or the like whereby the alarm producing sound will again be continuously operated until the operator again uses such temporary means or uses the on-off member 49 to completely turn off the alarm producing sound thereof.

Figure 11:
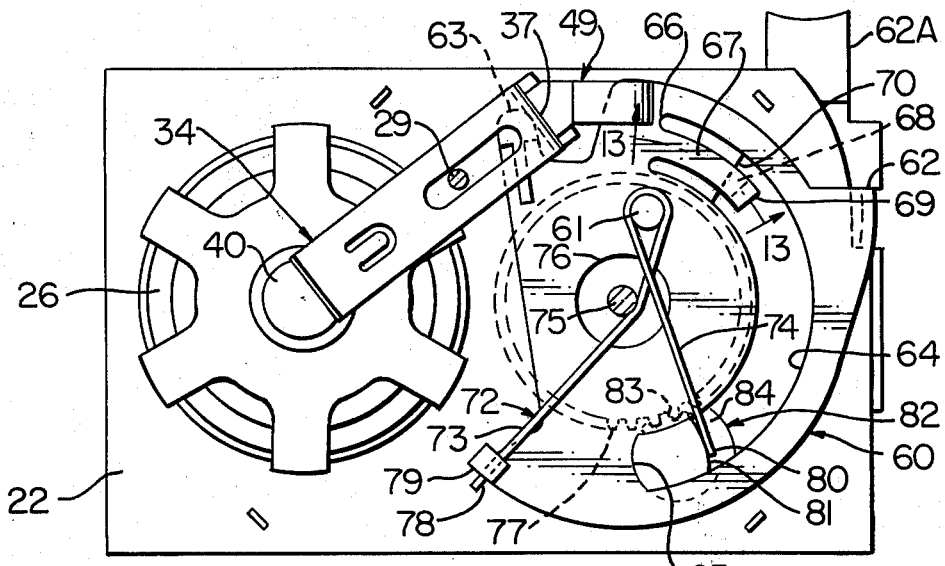
FIG. 11 is a fragmentary view similar to FIG. 10 and illustrates the clock mechanism set in a position for temporarily turning off the alarm producing means thereof.
Figure 12:
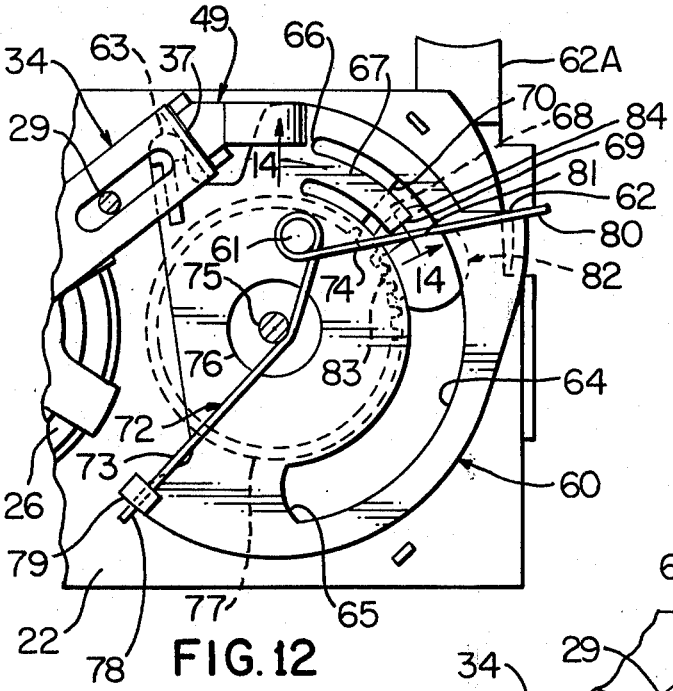
FIG. 12 is a view similar to FIG. 11 and illustrates the means for temporarily turning off the alarm producing means at the end of the time cycle therefor.
Figure 10:
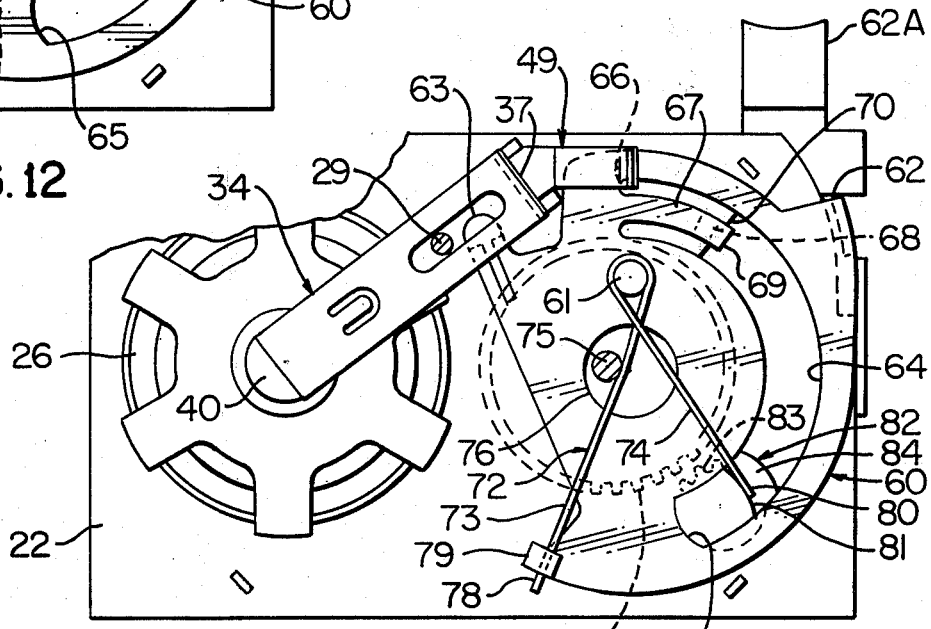
FIG. 10 is a fragmentary rear view of the clock structure illustrated in FIG. 2 and is taken in the direction of the arrows 10—10 thereof.
Figure 15:
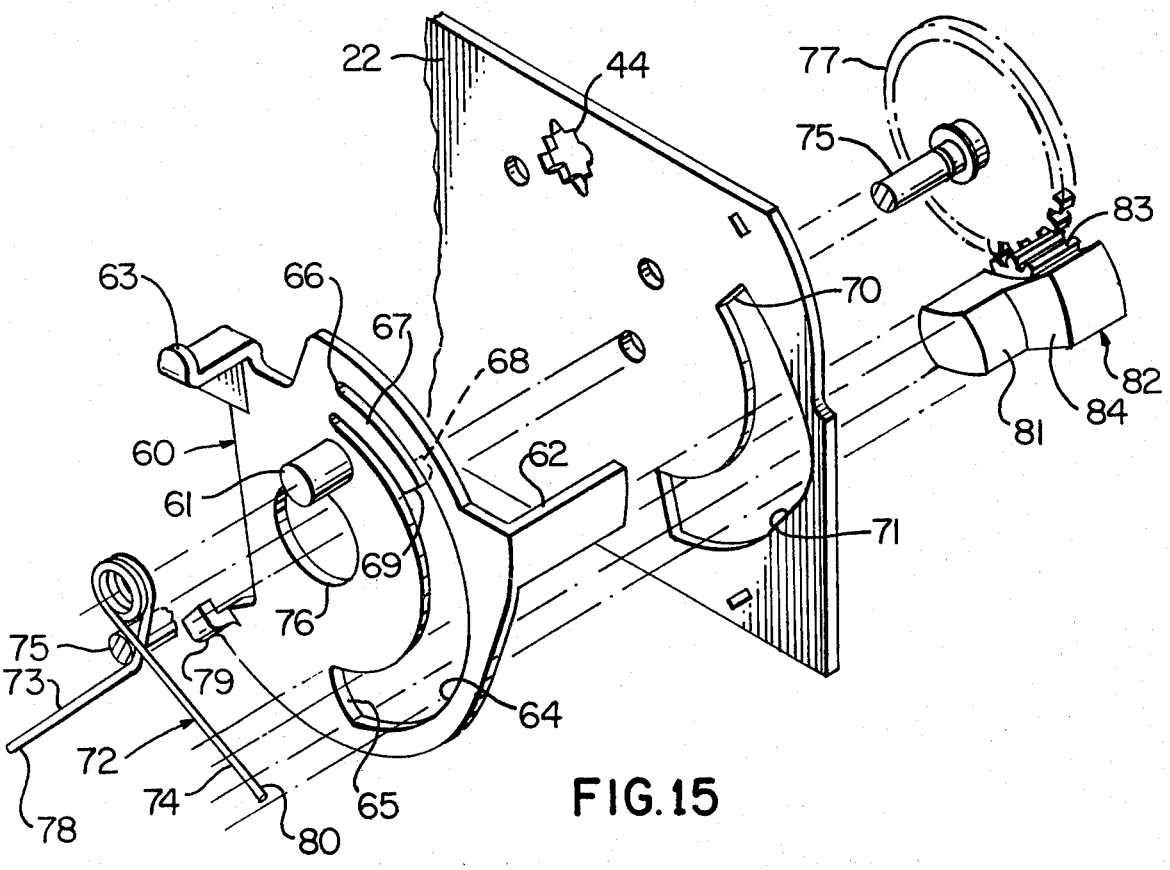
FIG. 15 is an exploded perspective view of the various parts of the means of FIG. 10 utilized to temporarily turn off the alarm producing means.
Figure 13:
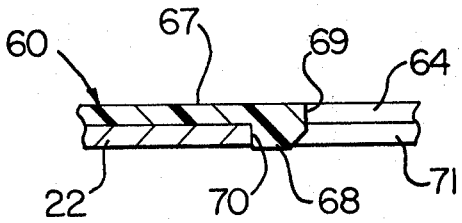
FIG. 13 is an enlarged fragmentary cross-sectional view taken on line 13—13 of FIG. 11.
Figure 14:
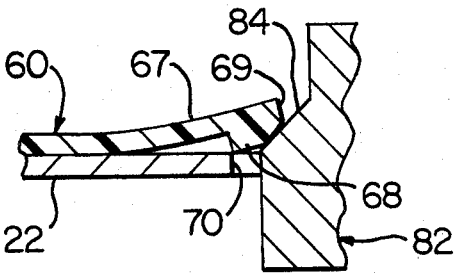
FIG. 14 is an enlarged fragmentary cross-sectional view taken on line 14—14 of FIG. 12.

In particular, reference is now made to FIGS. 10–12 wherein it can be seen that an actuator member or plate 60 is pivotally mounted to the frame plate 22 by a pivot post 61, the actuator plate 60 having a shoulder 62 which the operator of the clock construction 20 can engage with a movable slide or push button means 62A to manually move the actuator plate 60 from the alarm "on" position of FIG. 10 to the alarm "off" position of FIG. 11 when it is desired to temporarily stop the alarm producing sound of the alarm clock construction 20 in a manner hereinafter described.

The actuator plate 60 has an abutment 63 which is adapted to engage against the cross member 37 of the reed member 34 to pivot the reed member 34 out of its alarm sound producing condition of FIG. 5 to a non-alarm producing condition thereof, such as is illustrated in FIG. 4, when the actuator plate 60 is manually moved from the alarm "on" position thereof of FIG. 10 to the alarm "off" position thereof of FIG. 11.

The actuator plate 60 has an arcuate slot 64 passing completely therethrough and having opposed ends 65 and 66, the end 66 of the slot 64 having an integral latch tongue 67 projecting therein from the plate 60 and having a latch hook 68 depending from the free end 69 thereof for latching against a latch edge 70 of the frame plate 22 that is defined by one end of an arcuate slot 71 passing through the frame plate 22 and disposed in alignment with the arcuate slot 64 of the actuator plate 60.

In this manner, when the push button 62A is pushed downwardly from the position illustrated in FIG. 10 to the position illustrated in FIG. 11, the actuator plate 60 is rotated on its pivot pin 61 in a clockwise direction to cause the end 63 thereof to engage the cross member 37 of the reed member 34 to move the reed member 34 out of its alarm producing position while at the same time causing the latch hook 68 of the latch tongue 67 to snap downwardly against the latch ledge 70 of the plate 22 to latch the actuator plate 60 in its alarm "off" position of FIG. 11 and prevent the same from rotating in a counterclockwise direction back to its alarm "on" position of FIG. 10 under the force of a hair spring 72.

In particular, the hair spring 72 has two legs 73 and 74 formed by the hair spring 72 being looped around the pivot post 61 with the leg 73 engaging and forcing against a pinion shaft 75 that projects through a circular opening 76 of the actuator plate 60 and rotatably mounts a timing gear 77 of the timing means 25 to the frame plate 22 for a purpose hereinafter described, the leg 73 having its free end 78 bearing against an upstanding flange 79 of the actuator plate 60 as illustrated. The other leg 74 of the hair spring 72 has its free end 80 bearing against a part 81 of a pinion means 82 being carried by the actuator plate 60 while being movable relative thereto as the part 81 is slidably disposed in the arcuate slot 64 of the actuator plate 60 to be guided in its movement relative to the actuator plate 60 as will be apparent hereinafter. A pinion part 83 of the pinion means 82 comprises a plurality of gear teeth that are adapted to mesh with the gear teeth of the timer gear 77 for a purpose hereinafter described only when the actuator plate 60 is in the alarm "off" position of FIG. 12.

In any event, it can be seen that for force of the hair spring 72 through the end 80 of its leg 74 bearing against the part 81 of the pinion means 82 always tends to move the pinion means 82 in the slot 64 against the end 65 thereof and away from the latch tongue 67 for a purpose hereinafter described while the other leg 73 always tends to rotate the actuator plate in a counterclockwise direction in FIGS. 10–12. Of course suitable stops can be provided to limit the amount of rotational movement of the plate 60 relative to the frame plate 22.

The pinion means 82 has a slooping cam surface 84 disposed between the guide part 81 and pinion part 83 thereof for operating on the free end 69 of the latch tongue 67 to unlatch the latch tongue 67 from the latch ledge 70 of the frame plate 22 when the pinion means 82 has been moved to the position illustrated in FIG. 12 by the timing gear 77 in a manner hereinafter described.

Therefore, it can be seen that the actuator plate 60 and its associated parts that only comprise the hair spring 72 and pinion means 82 can be utilized with the clock construction 20 or not utilized with the clock construction 20 if desired.

However, if the actuator plate 60 and its associated parts 72 and 82 are assembled to the frame plate 22 of the alarm clock construction 20 of this invention in the manner illustrated in FIGS. 10–12, the actuator member or plate 60 can operate in a manner now to be described.

After the operator of the alarm clock construction 20 has set the on-off alarm member 49 to the "on" condition of FIG. 4 and the alarm sounding time of the alarm setting member 29 has been reached so that the alarm clock construction 20 is sounding its alarm in a manner provided by FIG. 5 and as previously described, the operator of the alarm clock construction 20, desiring to temporarily terminate the alarm sound for the certain time period of approximately 5 minutes so that that person can have an additional 5 minutes of sleep before being again awakened by the alarm clock construction 20, merely moves the push button 62A downwardly from the alarm "on" position of FIG. 10 to the alarm "off" position of FIG. 11 whereby such movement of the push button means 62A causes the actuator plate 60 to be rotated in a clockwise direction from the position of FIG. 10 to the direction of FIG. 11. Such movement of the actuating member 60 causes the hook 68 of the latch tongue 67 to snap over the latch ledge 70 of the frame plate 22 to prevent the hair spring 72 from rotating the actuating plate 60 back to the position of FIG. 10 in a counterclockwise direction when the operator releases the push button 62A.

Such clockwise movement of the actuator plate 60 from the position of FIG. 10 to the position of FIG. 11 about its pivot pin 61 causes the pinion teeth 83 of the pinion means 82 to be disposed in meshing relation with the gear teeth of the timer gear 77 whereby the continuously rotating timer gear 77, that rotates in a counterclockwise direction in FIGS. 10–12, begins to walk or carry the pinion means 82 therewith in a counterclockwise direction relative to the actuator plate 60 so as to move the pinion means 82 in the guide slot 64 from the position illustrated in FIG. 11 to the position illustrated in FIG. 12 in approximately 5 minutes.

When the actuator plate 60 is initially moved in the clockwise direction from the position of FIG. 10 to the position illustrated in FIG. 11 by the push button 62A, the abutment 63 of the actuator plate 60 engages against the cross member 37 of the reed member 34 to cause the same to pivot in a clockwise direction about the frame means 21 from the position illustrated in FIG. 5 substantially to the position illustrated in FIG. 4 and thereby terminate the alarm sound and since this movement of the actuator plate 60 causes the plate 60 to be latched by the latch tongue 67, the reed member 34 will be held in the non-alarm producing condition thereof until the actuator plate 60 is automatically unlocked by the pinion means 82 which happens approximately 5 minutes after the initial locking of the plate 60 in the position of FIG. 11.

In particular, when the gear 77 orbits the pinion means 82 from the position illustrated in FIG. 11 to the position illustrated in FIG. 12 in approximately 5 minutes, the cam surface 84 of the pinion means 82 cams against the end 69 of the latch tongue 67 to raise the hook 68 thereof away from its locking position with the ledge 70 of the plate 22 so that the force of the pair spring 72 will now cause the actuator plate 60 to rotate in a counerclockwise direction from the position illustrated in FIG. 12 back to the alarm "on" position of FIG. 10 and thereby freeing the abutment 63 from the cross member 37 of the reed member 34. In this manner, the force of the biasing member 50 of the on-off alarm member 49 can again pivot the reed member 34 in a counterclockwise direction from the position of FIG. 4 to the position of FIG. 5 and thereby cause the leg 35 of the reed member 34 to cooperate with the core 40 of the motor 26 and again produce the alarm sound thereof. At the same time, the leg 74 of the hair spring 72 now moves the pinion means 82 from the position illustrated in FIG. 12 back to the position illustrated in FIG. 10 because the previously described counterclockwise movement of the plate 60 from the position illustrated in FIG. 12 to the position illustrated in FIG. 10 has moved the pinion teeth 83 of the pinion means 82 out of meshing relation with the timing gears 77 so that the pinion means 82 is free to slide in the slot 84 and be moved against the end 65 thereof by the force of the hair spring 72.

Thus, the alarm clock construction 20 is now sounding its alarm through the freed reed member 34.

If the operator should again desire another 5 minute interval of having the alarm sound turned off, the operator can again move the plunger 62A downwardly from the position illustrated in FIG. 10 to the position illustrated in FIG. 11 and the alarm sound will again be temporarily terminated for the 5 minute period in the manner previously described so that the alarm clock construction will again produce the alarm sound thereof after the lapse of the new 5 minute time period.

Thus, the actuator plate 60 can be used over and over until the operator completely turns off the alarm feature of the alarm clock construction 20 by pushing inwardly on the on-off alarm member 49 in the manner previously described.

Figure 16:
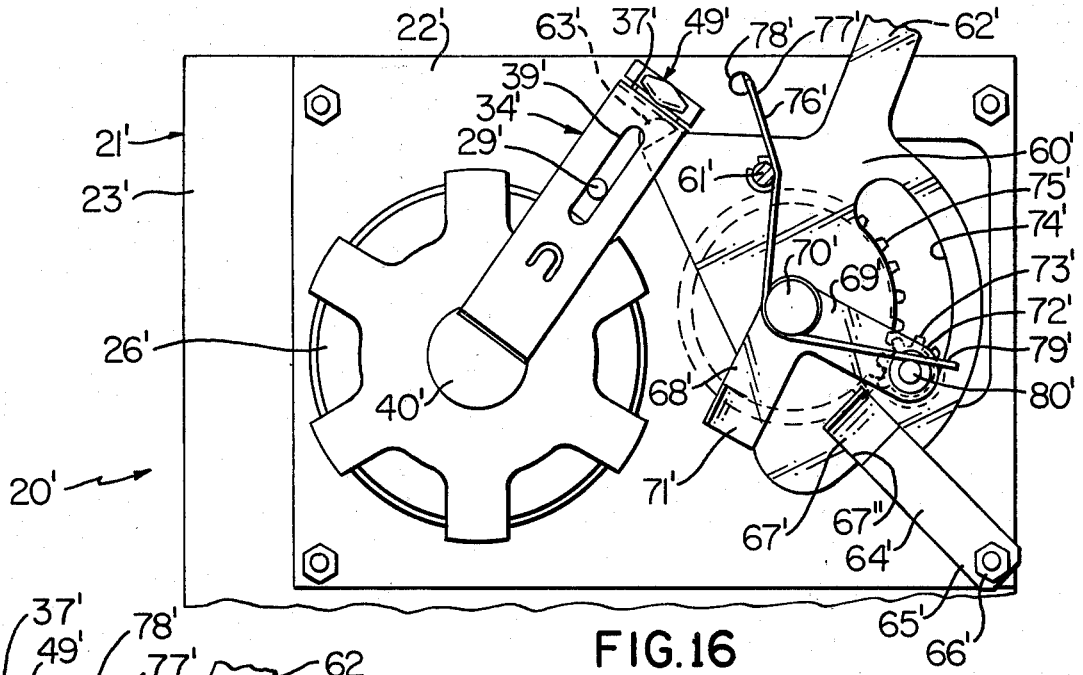
FIG. 16 is a view similar to FIG. 10 and illustrates another embodiment of the means for temporarily turning off the alarm producing means of the alarm clock construction of the invention.
Figure 17:
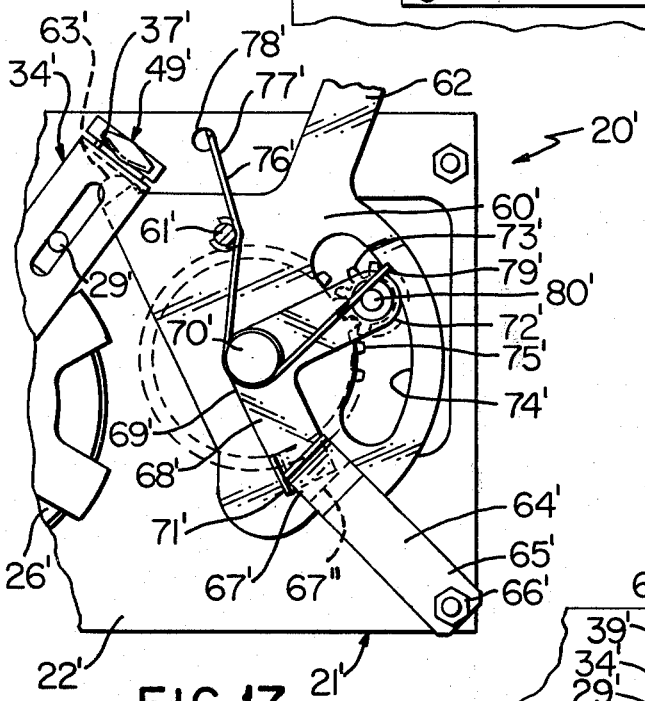
FIG. 17 is a view similar to FIG. 16 and illustrates the clock mechanism set in a position for temporarily turning off the alarm producing means thereof.
Figure 18:
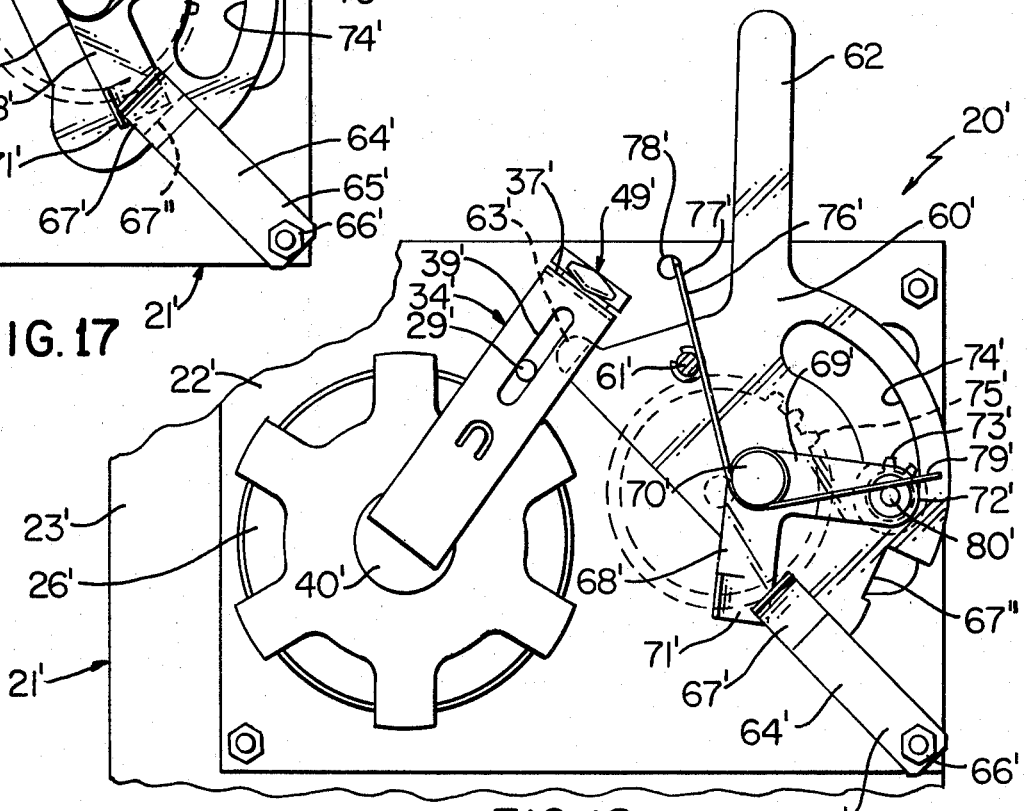
FIG. 18 is a view similar to FIG. 17 and illustrates the means for temporarily turning off the alarm producing means at the end of the time cycle thereof.

Another embodiment of the means of this invention for temporarily turning off the alarm producing sound thereof for a short interval of time that is useable with the clock construction 20 is illustrated in FIGS. 16–18 and certain parts thereof that are similar to certain parts of the clock construction 20 previously described are indicated by like reference numerals followed by a prime mark while other parts thereof that are different may still have a same reference numeral but will be followed by a prime mark and will be described in connection with the differences thereof.

Accordingly, reference is now made to FIGS. 16–18 wherein it can be seen that an actuator member or plate 60' is pivotally mounted to the frame plate 22' by a pivot post 61', the actuator plate 60' having an extension 62' which the operator of the clock construction 20' can manually move from the alarm "on" position of FIG. 18 to the alarm "off" position of FIG. 16 when it is desired to temporarily stop the alarm producing sound of the alarm clock construction 20' in a manner hereinafter described.

The actuator plate 60' has an abutment 63' which is adapted to engage against the cross member 37' of the reed member 34' to pivot the reed member 34' out of its alarm sound producing condition of FIG. 5 to a non-alarm producing condition thereof, such as is illustrated in FIG. 4, when the plate 60' is manually moved from the alarm "on" position of FIG. 18 to the alarm "off" position thereof of FIG. 16.

In order to hold the actuating plate 60' in the alarm "off" condition thereof as illustrated in FIG. 16, a spring latch member 64' has one end 65' thereof fastened to the plate 22' by the fastening means 66' while the other end 67' thereof is urged by the normal bias of the spring latch member 64' toward the plate 22' and, thus, will enter a locking notch 67' of the plate 60' to hold the same in the rotational position illustrated in FIG. 16.

An L-shaped lever member 68' has the elbow 69' thereof rotatably mounted to the plate 60' by a pivot post 70' carried by the plate 60', the L-shaped lever 68' having one end or leg 71' thereof for unlatching the latch member 64' in a manner hereinafter described and the other end or leg 72' thereof carring a non-rotatable pinion means 73' which extends through an arcuate slot 74' in the plate 60' and is adapted to be disposed in meshing relation with a gear 75' of the time means 25' when the plate 60' has been moved to the alarm "off" position of FIG. 16 as will be apparent hereinafter.

A hair-like spring 76' has one end 77' thereof disposed in an opening 78' of the frame plate 22' while the other end 79' thereof is disposed against a fixed post 80' that secures the pinion gear 73' to the leg 72' of the L-shaped lever 68' whereby the spring member 76' is disposed against the right side of the pivot post 61' of the plate 60' and bends around the left side of the pivot post 70' for the L-shaped member 68' in the manner illustrated in FIGS. 16 and 18.

Thus, the force of the hair-spring 76' tends to rotate the plate 60' in a counterclockwise direction about its pivot post 61' and hold the plate 60' in its alarm "on" condition of FIG. 18 so as to have its abutment 63' out of the path of movement of the cross member 37' of the reed member 34' when the same has moved to the alarm producing condition of FIG. 5.

Therefore, it can be seen that the actuator member or plate 60' and the associated parts 64', 68' and spring 76' can be utilized with the clock construction 20' or not utilized with the clock construction 20' if desired.

However, if the plate 60' and its associated parts 64' and 68' are assembled to the plate 22' of the alarm clock construction 20' of this invention in the manner illustrated in FIGS. 16–18, the actuator plate 60' can operate in a manner now to be described.

After the operator of the alarm clock construction 20' has set the on-off alarm member 49' to the "on" condition of FIG. 4 and the alarm sounding time of the alarm setting member 29' has been reached so that the alarm clock construction 20' is sounding its alarm in the manner provided by FIG. 5 and as previously described, the operator of the alarm clock construction 20', desiring to temporarily terminate the alarm sound for the certain time period of approximately five minutes so that that person can have an additional five minutes of sleep before being again awakened by the alarm clock construction 20', merely moves the lever 62' from the alarm "on" position of FIG. 18 to the alarm "off" position of FIG. 16 whereby such movement of the lever 62' causes the plate 60' to rotate in a clockwise direction to the position of FIG. 16 to not only cause the abutment 63' thereof to engage against the cross member 37' of the reed member 34' to cause the reed member 34' to pivot in a clockwise direction about the frame means 21' from the position illustrated in FIG. 5 substantially to the position illustrated in FIG. 4 and thereby terminate the alarm sound, but also the plate 60' is moved so that the latch member 64' forces its end 67' into the latch notch 67'' of the plate 60' to hold the same in the position of FIG. 16 in opposition to the force of the hair spring 76' tending to rotate the plate 60' in a counterclockwise direction.

When the plate 60' has been rotated to the position illustrated in FIG. 16, it can be seen that the pinion gear 73' that is fixed to the L-shaped lever 68' is brought into meshing relation with the rotating gear 75' of the time means 25' which causes the gear 73' to orbit or revolve relative to post 70' and thereby walk through the slot 74' in the plate 60' from the position illustrated in FIG. 16 to eventually the position illustrated in FIG. 17 after the lapse of the temporary time period, such as five minutes. As the gear 75' is moved from the position illustrated in FIG. 16 to the position illustrated in FIG. 17, it can be seen that the lever 69' is pivoted on the post 70' in a counterclockwise direction and thereby causes the end 71' of the lever 68' to work under the latch end 67' of the latch member 64' and raise the same from the latch notch 67'' of the plate 60'.

With the L-shaped lever 68' now lifting the latch end 67' of the latch member 64' from the latch notch 67'' of the plate 60', the force of the hair spring 76' can now cause the plate 60' to rotate from the position illustrated in FIG. 17 back to the position illustrated in FIG. 18 whereby the abutment 63' of the plate 60' is moved out of the path of the cross member 37' of the reed member 34' so that the force of the leaf member 60' of the on-off alarm member 49' can again pivot the reed member 34' in a counterclockwise direction from the position of FIG. 4 to the position of FIG. 5 and thereby cause the leg 35' of the reed member 34' to cooperate with the core 40' of the motor 26' and again produce the alarm sound thereof. At the same time, the hair spring 76' causes the lever 68' to rotate in a clockwise direction to again bring the gear 73' carried thereby back to the position illustrated in FIG. 18 because the gear 73' is moved out of meshing relation with the gear 75' when the plate 60' is pivoted in the counterclockwise direction by the hair spring 76'.

If the operator should again desire another five minute interval of having the alarm sound turned off, the operator can again move the lever 62' from the position illustrated in FIG. 18 to the position illustrated in FIG. 16 and the alarm sound will again be temporarily terminated for the five minute period in the manner previously described so that the alarm clock construction will again produce the alarm sound thereof after the lapse of the new five minute time period.

Thus, the actuating plate 60' can be used over and over until the operator completely turns off the alarm feature by pushing inwardly on the on-off alarm member 49' in the manner previously described.

Therefore, it can be seen that this invention provides an improved alarm clock construction.

While the forms of the invention now preferred have been illustrated and described as required by the Patent Statute, it is to be understood that other forms can be utilized and still fall within the scope of the appended claims.

What is claimed is:

1. In an alarm clock construction having frame means carrying time means and a timer motor for driving said time means, said time means including an alarm setting means for selecting a predetermined time said clock construction is to sound an alarm, said alarm sound being adapted to be created by a reed member pivotally carried by said frame means and being controlled by an on-off alarm member movably carried by said frame means, the improvement wherein said reed member has an intermediate pivot point that pivots on said frame means to permit said reed member to pivot to an alarm producing position when said time means reaches said predetermined time, said on-off alarm member having biasing means for acting on said reed member on one side of said intermediate pivot point to tend to bias said reed member to said alarm producing position when said on-off alarm member is in the "on" position thereof and for acting on said reed member on the other side of said intermediate pivot point to tend to bias said reed member out of said alarm producing position when said on-off alarm member is in the "off" position thereof, said biasing means of said on-off alarm member comprising a leaf spring member engageable with and slidable relative to said reed member, said reed member having a slot therein that extends from one side of said pivot to the other side of said pivot point, said leaf spring member having a tang disposed in said slot to guide movement of said on-off alarm member relative to said reed member.

2. In an alarm clock construction having frame means carrying time means and a timer motor for driving said time means, said time means including an alarm setting means for selecting a predetermined time said clock construction is to sound an alarm, said alarm sound being adapted to be created by a reed member pivotally carried by said frame means and being controlled by an on-off alarm member movably carried by said frame means, the improvement wherein said reed member has an intermediate pivot point that pivots on said frame means to permit said reed member to pivot to an alarm producing position when said time means reaches said predetermined time, said on-off alarm member having biasing means for acting on said reed member on one side of said intermediate pivot point to tend to bias said reed member to said alarm producing position when said on-off alarm member is in the "on" position thereof and for acting on said reed member on the other side of said intermediate pivot point to tend to bias said reed member out of said alarm producing position when said on-off alarm member is in the "off" position thereof, said reed member having opposed ends, one of said ends of said reed member being movable to closely adjacent said motor to cooperate therewith and provide said alarm sound when said reed member is pivoted to said alarm producing position thereof, the other end of said reed member being operatively associated with said alarm setting means to be operated thereby.

3. An alarm clock construction as set forth in claim 2 wherein said alarm setting means comprises a shaft carrying a cam plate and a time driven wheel axially movable thereon and having a cam position receivable in said cam plate when said predetermined time is reached, said other end of said reed member being biased by said on-off alarm member against said wheel in a direction to tend to move said wheel toward said cam plate so that said reed member pivots to said alarm producing position when said cam portion of said wheel is received in said cam plate and said on-off member is set in said "on" position thereof.

4. An alarm clock construction as set forth in claim 3 wherein said reed member is substantially U-shaped with said opposed ends being the legs of said U-shape, the cross member of said U-shape being the part of said reed member that is pivotally mounted to said frame means.

5. An alarm clock construction as set forth in claim 4 wherein said reed member is a one-piece structure.

6. An alarm clock construction as set forth in claim 4 wherein said frame means includes a pair of spaced plates respectively having opening means passing therethrough, said cross member of said U-shaped reed member being disposed in said openings of said plates with said legs thereof being respectively disposed on opposite sides of said plates, said cross member of said U-shaped reed member being pivoted to one of said plates at said opening thereof.

7. In an alarm clock construction having frame means carrying time means and a timer motor for driving said time means, said time means including an alarm setting means for selecting a predetermined time said clock construction is to sound an alarm, said alarm sound being adapted to be created by a reed member pivotally carried by said frame means and being controlled by an on-off alarm member movably carried by said frame means, the improvement wherein said reed member has an intermediate pivot point that pivots on said frame means to permit said reed member to pivot to an alarm producing position when said time means reaches said predetermined time, said on-off alarm member having biasing means for acting on said reed member on one side of said intermediate pivot point to tend to bias said reed member to said alarm producing position when said on-off alarm member is in the "on" position thereof and for acting on said reed member on the other side of said intermediate pivot point to tend to bias said reed member out of said alarm producing position when said on-off alarm member is in the "off" position thereof, and actuator means carried by said frame means for temporarily moving said reed member out of said alarm producing position thereof for a certain time period.

8. An alarm clock construction as set forth in claim 7 wherein said actuator means comprises an actuator member pivotally mounted to said frame means and having an abutment means for engaging said reed member and moving said reed member out of said sound producing position thereof when said actuator member is moved to a first position thereof.

9. An alarm clock construction as set forth in claim 8 wherein said frame means has latch means for latching said actuator member in said first position thereof when said actuator member is moved to said first position thereof.

10. An alarm clock construction as set forth in claim 9 wherein said actuator member carries means for unlatching said latch means after said certain time period has lapsed.

11. An alarm clock construction as set forth in claim 10 wherein said means for unlatching said latch means comprises a pinion means movably carried by said actuator member.

* * * * *